United States Patent [19]

Karwat

[11] Patent Number: 4,478,798

[45] Date of Patent: Oct. 23, 1984

[54] PREVENTION OF CARBONYL FORMATION TO AVOID FOULING OF SOUR GAS ABSORPTION SYSTEM

[75] Inventor: Heinz Karwat, Pullach, Fed. Rep. of Germany

[73] Assignee: Linde Aktiengesellschaft, Wiesbaden, Fed. Rep. of Germany

[21] Appl. No.: 447,820

[22] Filed: Dec. 8, 1982

[30] Foreign Application Priority Data

Dec. 8, 1981 [DE] Fed. Rep. of Germany ..... 3148518

[51] Int. Cl.[3] ..... C01B 17/16; B01D 53/34

[52] U.S. Cl. ..... 423/224; 423/226; 55/72; 55/73

[58] Field of Search ..... 55/72, 73; 423/224, 423/226

[56] References Cited

U.S. PATENT DOCUMENTS

| | | | |
|---|---|---|---|
| 3,255,572 | 6/1966 | Miller et al. | 55/72 |
| 3,688,474 | 9/1972 | Head et al. | 55/72 |
| 4,087,258 | 5/1978 | Baron et al. | 55/73 |
| 4,142,875 | 3/1979 | Bohmholdt et al. | 55/72 |
| 4,144,314 | 3/1979 | Doerges et al. | 55/73 |
| 4,155,988 | 5/1979 | Karwat et al. | 55/73 |
| 4,345,918 | 8/1982 | Meissner | 55/73 |
| 4,348,368 | 9/1982 | Blytas et al. | 423/224 |

FOREIGN PATENT DOCUMENTS

| | | | |
|---|---|---|---|
| 2644323 | 6/1978 | Fed. Rep. of Germany | 423/226 |
| 78927 | 5/1982 | Japan | 423/224 |
| 130531 | 8/1982 | Japan | 423/224 |
| 673310 | 7/1979 | U.S.S.R. | 423/224 |

*Primary Examiner*—R. L. Andrews
*Assistant Examiner*—Terryence Chapman
*Attorney, Agent, or Firm*—Millen & White

[57] ABSTRACT

For avoiding equipment fouling from metal sulfide deposition in the processing of cracked gases containing $H_2S$ and CO, the reactive metal species capable of carbonyl formation are prevented from contacting equipment parts operating within a temperature range favoring the formation of metal carbonyls, e.g., 30°-250° C. To accomplish this, the cracked gas is subjected to solids separation to remove dust particles containing the reactive metal species, or the cracked gas is oxidized to inactivate the metal species. Cooling water is also subjected to a preceding step of removing the reactive metal species.

32 Claims, 1 Drawing Figure

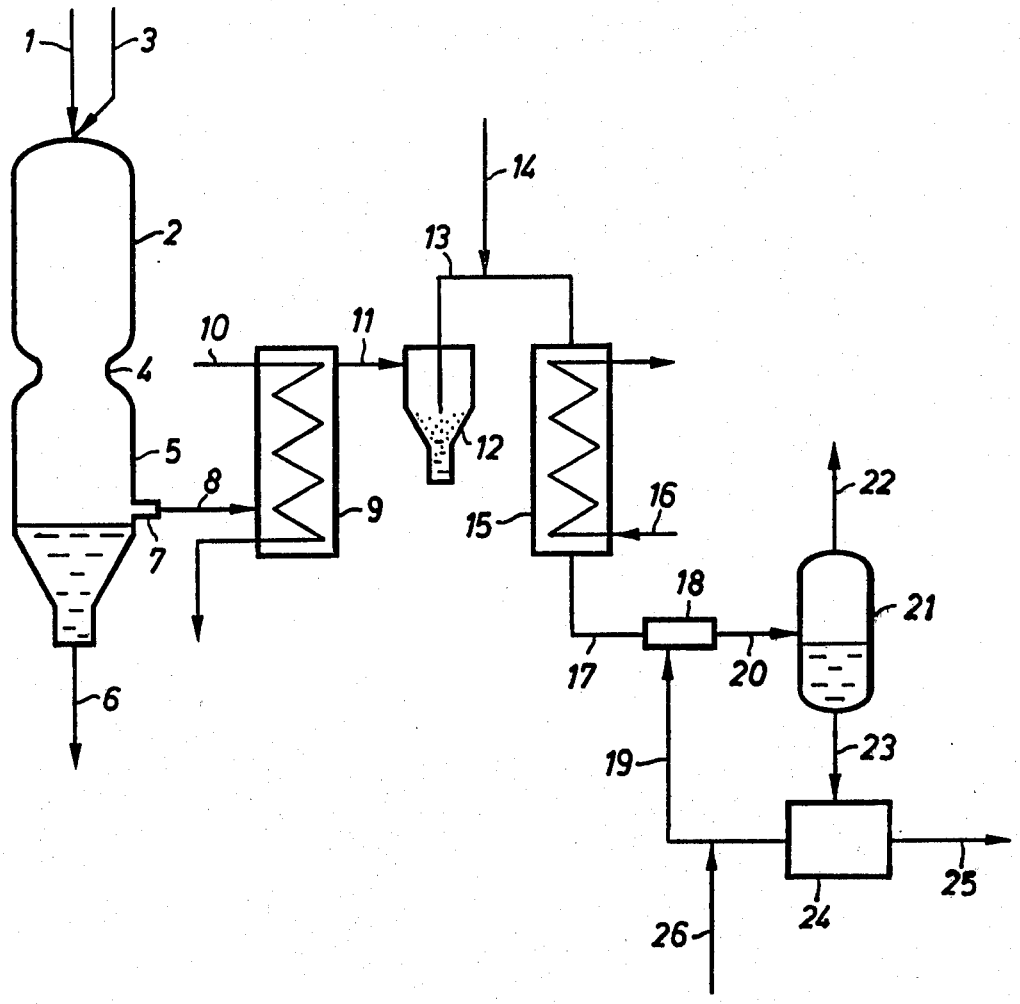
1
3
2
4
5
8
7
6
10
11
9
13
14
12
15
16
22
18
21
17
20
19
23
24
25
26

PREVENTION OF CARBONYL FORMATION TO AVOID FOULING OF SOUR GAS ABSORPTION SYSTEM

BACKGROUND OF THE INVENTION

This invention relates to a process for the prevention of equipment fouling, e.g., plugging of heat exchangers, with metallic sulfides during the processing and purification of cracked gases.

It is well known that a severe problem is caused by the fouling of equipment with metallic sulfides during the course of the processing of cracked gases produced by the gasification of solid or liquid fuels with steam and oxygen under pressure and elevated temperature, which gases are further processed into $H_2$—CO synthesis gases or $H_2$—$N_2$ synthesis gases. It has been recognized that this problem is, in the final analysis, due to metal carbonyls formed during the course of processing of the cracked gases. The metal carbonyls in turn form sulfides with sulfur compounds present in the cracked gas or other compounds used in the process, and these sulfides, in turn, are deposited on certain parts of the apparatus and foul same during the course of time.

To improve these conditions, it has been known from DAS (German Published Examined Application) No. 2,706,152, to cool the raw gas to temperatures of 20°-150° C. and treat the gas with solvents for the extraction, inter alia, of carbonyl-forming metals from the gas. However, it has been found that this conventional process nevertheless results in equipment fouling after a period of time insofar as less than 100% of the carbonyl-forming metals are extracted.

SUMMARY

An object of this invention is to provide an improved process for preventing the formation of deposits during the further processing of the gas.

Upon further study of the specification and appended claims, further objects and advantages of this invention will become apparent to those skilled in the art.

To attain these objects, the process comprises, in its fundamental aspect, the step of maintaining compounds of metals capable of carbonyl formation out of contact with equipment parts operating at a temperature range favoring metal carbonyl formation, e.g. of between about 30° and 250° C. using conventional pressure and concentration conditions for the carbon monoxide.

The invention is based on the realization that effective prevention of deposits of metallic sulfides is possible by avoiding the formation of metal carbonyls in the gas to be processed. The metal carbonyls are not present as such in the cracked gas exiting from the cracking furnace at temperatures of 1200°-1300° C. Rather, they are produced because of the simultaneous presence of carbon monoxide, always present in cracked gases, and metals capable of carbonyl formation, such as, for example, iron and nickel. The thermodynamic equilibrium of the reaction between the metals and carbon oxide, at temperatures above about 250° C., strongly favors the reactants (i.e. the decomposition reaction), so that almost no metal carbonyls are formed in higher temperature ranges. However, below this temperature down to approximately 30° C., metal carbonyls are formed to a considerable extent, up to 20% of the metal introduced with the feed.

Below about 30° C., the thermodynamic equilibrium of the components strongly favors the formation of the metal carbonyls, but, for reasons of reaction kinetics, there occurs almost no reaction between metals and carbon oxide at lower than 30° C.

Metal carbonyls are normally highly soluble in methanol. As is known, methanol is a widely used scrubbing medium for the purification of cracked gases to remove carbon dioxide and hydrogen sulfide. After the scrubbing step, the metal carbonyls, together with $CO_2$ and $H_2S$, then pass into the heat exchangers located downstream of the scrubbing column and into the subsequent regenerating column where the loaded methanol is freed of the absorbed components by expansion and heating. At these locations, the metal carbonyls tend to decompose due to the lowering of the CO partial pressure and the heating, and to leave behind iron and nickel, which metals react with the hydrogen sulfide present in the methanol to form difficultly soluble metal sulfide precipitates which adhere to the walls of the equipment, gradually leading to plugging of same.

The teaching of this invention, therefore, resides in positively preventing carbonyl formation by providing that one of the two reactants is absent in the temperature range favoring carbonyl formation. Accordingly, knowledge of this carbonyl favoring temperature range under the reaction conditions is critical to the success of the invention.

The critical temperature range is dependent, to a certain degree, on the pressure to which the gas is exposed and on the carbon monoxide concentration in the gas. Using conventional gasification pressures of about 80 atm. absolute and with a conventional concentration of about 50% by volume CO in the cracked gases, this critical temperature range is in the range of about 30° C. to about 250° C., wherein appreciable formation of metal carbonyls occurs. Outside of this critical temperature range, less than 0.2 mg/$Nm^3$ gas of metal carbonyls are formed, and this is another way of defining the critical temperature range.

Although a certain beneficial effect would still be achieved by removing the compounds forming metal carbonyl out of contact with the equipment within a more restricted temperature range, at, for example, 200° C. for the purpose of avoiding exposure of the equipment to excessively high temperatures, such an effect would necessarily be incomplete and fouling of equipment parts with metallic sulfides would occur by virtue of the equipment being in contact with compounds forming metal carbonyl at other temperatures within the critical range.

At a pressure of 30 atm. absolute the critical temperature range would reach from about 30° C. to about 180° C.

The aforementioned compounds of the carbonyl-forming metals are present in dust form in the cracked gas, and they originate from the fuels utilized for gasification. The cracked gases exit from the gasification reactors at a temperature of 1200°-1300° C., depending on the type of gasification. Accordingly, under the aforementioned conventional conditions, the gases must be freed of the compounds of metals capable of carbonyl formation before the gases have cooled down to a temperature of about 250° C.

This is accomplished according to this invention advantageously with the aid of conventional cyclones; however, filters have also proven to work well. A high-pressure water washing step turned out to be very advantageous for the removal of such compounds, but such procedure can only be conducted up to maximally 375° C. on account of the critical point of the water. Since precaution must be taken that the water wash is conducted with water above the lower limit of 250° C., it is preferred that the water for the water wash be injected at a temperature of 260° to 300° C., and under a pressure of 45 to 90 bar.

Compounds of carbonyl-forming metals may be introduced into the process, besides by the cracked gas, also by process water if, as is frequently the case, the cooling of the cracked gas to about room temperature is performed by the direct injection of water. For economic considerations, water obtained somewhere in the process is used for this purpose, rather than fresh water.

If such process water is utilized for cooling the cracked gas to between 250° and 30° C. it is also necessary according to the invention to remove the compounds of the metals capable of carbonyl formation from this water before it is employed as cooling water.

If such compounds are present as a suspension in the process water, then the simplest method is filtration or centrifuging.

If these compounds are present in dissolved form, then extraction or a precipitation method is expedient, for example precipitation as sulfides. Besides this flocculation methods (if Ni is in colloidal form) or methods based on the formation of complexes (e.g. Ni with dimethylglyoxim) have shown to be of advantage. Moreover, ion exchangers have proved useful.

According to a particular embodiment of the idea of this invention, the aforementioned compounds can also be rendered harmless by oxidation, for it has been found that primarily the divalent metallic compounds, or the metals themselves, are responsible for the formation of the interfering metal carbonyls, rather than the higher-valency metal compounds produced by oxidation of the metal compounds.

The oxidizing agent in this connection can be added either to the process water or to the cracked gas.

The cheapest oxidizing medium is an oxygen-containing gas, such as air, for example. With nickel carbonyl, for instance, an addition of 10 up to 300 ppm $O_2$ to the gas proved to be advantageous, the oxygen being in the form of air or pure oxygen gas. Advantageously the oxidizing medium may be added in small portions distributed all over the cooling length.

However, more vigorous oxidizing agents, such as hydrogen peroxide or ozone, can likewise be employed, as well as sulfur dioxide, nitrogen dioxide, or halogens, such as iodine, bromine or chlorine.

In accordance with a further development of this invention, it is also sufficient, to prevent metal carbonyl formation, to generate an acidic environment in the process water by maintaining a pH up to 6, preferably a pH of 2 to 4. It has been determined that, in the acidic range, nickel is no longer capable of reacting with carbon monoxide. Suitable acids for generating an acidic environment are citric acid, sulfuric acid or phosphoric acid.

Without further elaboration, it is believed that one skilled in the art can, using the preceding description, utilize the present invention to its fullest extent. The following preferred specific embodiment according to the FIGURE is, therefore, to be construed as merely illustrative, and not limitative of the remainder of the disclosure in any way whatsoever. In the following example, all temperatures are set forth uncorrected in degrees Celsius; unless otherwise indicated, all parts and percentages are by weight.

BRIEF DESCRIPTION OF DRAWING

The attached FIGURE is a schematic flowsheet of a preferred specific embodiment of the invention.

DETAILED DESCRIPTION OF THE DRAWING

Via conduit 1 a carbon carrier such as coal slurry or heavy oil and water vapor is introduced into a reactor 2. Via conduit 3 oxygen is fed also into the reactor. Within the reactor, a partial oxidation of the carbon carrier takes place at a temperature between 1200° and 1600° C. resulting in a synthesis raw gas. Reactor chamber 2 does not contain any installations. Afterwards the hot gas penetrates contraction 4 and enters slag skimmer 5 arranged beneath. Slag contained in the gas stream is drawn off from the lower part of slag skimmer 5 via conduit 6, while the gas leaves via socket 7 and conduit 8 and is conducted to waste-heat boiler 9. Here an indirect heat exchange is performed between the gas and high pressure water introduced via conduit 10. Thereby the bulk of the heat content of the gas is recovered under production of high-grade superheated high pressure steam. A maximum utilization of the process heat would be given if the synthesis gas were cooled down near its dew point, which usually lies between 150° and 250° C. In order to prevent the formation of metal carbonyls, however, the synthesis gas is drawn off from the waste-heat boiler 9 at a temperature of about 400° C. From there it is introduced via conduit 11 into a cyclone 12, where the bulk of the carbon black and the solids are removed. The cleaned gas leaves via conduit 13, is enriched with oxygen via conduit 14. By this addition the formation of metal carbonyls is suppressed. Afterwards the gas is led to economizer 15, where it is brought into indirect heat exchange with low pressure water flowing through conduit 16, thus producing low pressure water vapor. The gas leaving economizer 15 has a temperature of about 200° C. Through conduit 17 it flows into a mixing chamber 18 in which circulating water from conduit 19 is sprayed into the gas stream. By this contact with cooling water the temperature is lowered to about 160° C., residues of carbon black are washed out and the formation of carbonyl forming compounds is largely suppressed. On the one side, this is due to a decrease of the partial pressure of those components of the synthesis gas which are capable to react with metal compounds, owing to the evaporation of the cooling water. On the other side, the metal compounds contained in the synthesis gas which have not yet reacted are dissolved or precipitated in the excess water and thereby removed from the synthesis gas. The mixture of synthesis gas and cooling water is introduced into a separator 21 via conduit 20. In this separator the contaminated water is separated and the synthesis gas flows through conduit 22 to its intended purpose. The separated water is drawn off from separator 21 via conduit 23, is cooled back in a water purification plant 24 and freed from the inherent metal compounds by means of cyclones or filters. Moreover, sulfides are removed. Concentrated impurities are drawn off via conduit 25 and purified and cooled circulation water is re-fed to the mixing chamber 18 via conduit 19. Cooling water losses are balanced by the addition of fresh water through conduit 26. At the same time the pH-value is adjusted to 2 to 4 by an additive of citric or sulphuric acid to the fresh water.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

I claim:

1. In a process for avoiding equipment fouling with metallic sulfides comprising the steps of processing and purifying cracked gases containing CO, $H_2S$ and reactive metal species capable of carbonyl formation, the improvement comprising maintaining said reactive metal species capable of carbonyl formation out of contact with equipment parts operating within a temperature range favoring the formation of metal carbonyls to the extent of at least 0.2 mg of metal carbonyl per $Nm^3$ of gas; and outside of said temperature range, less than 0.2 mg of metal carbonyls per $Nm^3$ of gas being formable.

2. A process according to claim 1, wherein the cracked gas is under a pressure of about 80 atmospheres absolute and contains about 50% by volume of carbon monoxide, and said metal carbonyl-favoring temperature range is about 30°–250° C.

3. A process according to claim 2, comprising separating the metallic compounds present in the cracked gas during the course of cooling the cracked gases within a temperature range of 1300° C. to 250° C.

4. A process according to claim 3, wherein the metallic compounds are separated within a temperature range of 700°–280° C.

5. A process according to claim 3, wherein the separating is conducted in a cyclone at about 400° C.

6. A process according to claim 3, wherein the separating is conducted through a filter.

7. A process according to claim 3, wherein the separating is conducted by a high-pressure water scrubbing step within a temperature range from 375° C. to 250° C.

8. A process according to claim 1, further comprising the step of employing water to cool the cracked gas to within the metal carbonyl-favoring temperature range, and preceding said step, removing compounds of reactive metal species capable of carbonyl formation from said water.

9. A process according to claim 8, further comprising adding an oxidizing agent to the water and/or the cracked gas to convert said reactive metal species to a higher valence, said higher valence metal species being non-reactive for the formation of metal carbonyl.

10. A process according to claim 9, wherein said oxidizing agent is an oxygen-containing gas.

11. A process according to claim 9, wherein said oxidizing agent is hydrogen peroxide or ozone.

12. A process according to claim 9, wherein said oxidizing agent is sulfur dioxide or nitrogen oxide.

13. A process according to claim 9, wherein said oxidizing agent is a halogen.

14. A process according to claim 8 wherein said metal carbonyl-favoring temperature range is 30°–250° C.

15. A process according to claim 1, further comprising the step of employing water to cool the cracked gas to within the metal carbonyl-favoring temperature range, said water containing reactive metals and having a pH value up to 6 in the water so as to prevent said reactive metals from reacting with carbon monoxide.

16. A process according to claim 15 wherein said metal carbonyl-favoring temperature range is 30°–250° C.

17. A process according to claim 16 wherein the pH of the water is 2–4.

18. A process according to claim 1, wherein an oxidizing agent is added to the cracked gas prior to said gas being cooled to the temperature favoring metal carbonyl formation, said oxidizing agent converting said reactive metal species to a higher valence metal species being non-reactive for the formation of metal carbonyl.

19. A process according to claim 18, wherein the cracked gas is under a pressure of about 80 atmospheres absolute and contains about 50% by volume of carbon monoxide, and said metal carbonyl-forming temperature range is about 30°–250° C.

20. A process according to claim 19, wherein the oxidizing agent is an oxygen containing gas, ozone, hydrogen peroxide, sulfur dioxide, nitrogen dioxide or a halogen.

21. A process according to claim 1 wherein said reactive metal species is iron or nickel.

22. In a process comprising the steps of processing and purifying cracked gases containing CO, $H_2S$ and reactive metal species capable of carbonyl formation, the improvement of avoiding equipment fouling with metallic sulfides comprising maintaining said reactive metal species capable of carbonyl formation out of contact with equipment parts operating within a temperature range favoring the formation of metal carbonyls, said temperature range being 30°–250° C.

23. A process according to claim 22 wherein said reactive metal species is iron or nickel.

24. In a process comprising water scrubbing a gas containing CO, $H_2S$ and reactive metal species capable of carbonyl formation, wherein said scrubbing water is recycled, the improvement comprising adding an oxidizing agent to the water to convert said reactive metal species to a higher valence, said higher valence metal species being non-reactive for the formation of metal carbonyl.

25. A process according to claim 24, wherein said oxidizing agent is an oxygen-containing gas.

26. A process according to claim 24, wherein said oxidizing agent is hydrogen peroxide or ozone.

27. A process according to claim 24, wherein said oxidizing agent is sulfur dioxide or nitrogen oxide.

28. A process according to claim 24, wherein said oxidizing agent is a halogen.

29. A process according to claim 24 wherein said reactive metal species is iron or nickel.

30. In a process comprising water scrubbing a gas containing CO, $H_2S$ and reactive metal species capable of carbonyl formation, wherein said scrubbing water is recycled, the improvement comprising maintaining a pH value up to 6 in the water so as to prevent said reactive metals from reacting with carbon monoxide.

31. A process according to claim 30 wherein the pH of the water is 2–4 and the reactive species is nickel.

32. A process according to claim 30 wherein said reactive metal species is iron or nickel.

* * * * *